US009789683B2

(12) United States Patent
Matsuda

(10) Patent No.: US 9,789,683 B2
(45) Date of Patent: Oct. 17, 2017

(54) EJECTION DEVICE

(71) Applicant: Funai Electric Co., Ltd., Osaka (JP)

(72) Inventor: Yasunori Matsuda, Yawata (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 15/205,724

(22) Filed: Jul. 8, 2016

(65) Prior Publication Data

US 2017/0008277 A1 Jan. 12, 2017

(30) Foreign Application Priority Data

Jul. 9, 2015 (JP) ..... 2015-137923
Jun. 27, 2016 (JP) ..... 2016-126460

(51) Int. Cl.

| | |
|---|---|
| ***B41J 2/045*** | (2006.01) |
| ***B41J 3/407*** | (2006.01) |
| ***B41J 11/00*** | (2006.01) |
| ***B41J 11/46*** | (2006.01) |
| ***B41J 25/00*** | (2006.01) |
| *A45D 29/00* | (2006.01) |

(52) U.S. Cl.

CPC ..... *B41J 2/04536* (2013.01); *B41J 2/04586* (2013.01); *B41J 3/407* (2013.01); *B41J 11/008* (2013.01); *B41J 11/0015* (2013.01); *B41J 11/46* (2013.01); *B41J 25/001* (2013.01); *A45D 2029/005* (2013.01)

(58) Field of Classification Search

CPC ..... B41J 11/0015; B41J 11/008; B41J 11/46; B41J 3/407; B41J 25/001; B41J 2/04536; B41J 2/04586; B41J 2/04505; B41J 11/42; A45D 2029/005

USPC ..... 347/14

See application file for complete search history.

(56) References Cited

U.S. PATENT DOCUMENTS

| | | | | |
|---|---|---|---|---|
| 2005/0057595 | A1 | 3/2005 | De Grijs | |
| 2007/0049832 | A1* | 3/2007 | Edgar | A61B 5/0064 600/476 |
| 2011/0273504 | A1* | 11/2011 | Boesten | B41J 2/2128 347/14 |
| 2014/0320868 | A1* | 10/2014 | Shaked | B41J 11/008 358/1.2 |

FOREIGN PATENT DOCUMENTS

JP 2012-232039 A 11/2012

OTHER PUBLICATIONS

Extended European Search Report issued in corresponding European Application No. 16178890.6 dated Feb. 14, 2017 (7 pages).

* cited by examiner

*Primary Examiner* — Huan Tran
*Assistant Examiner* — Alexander D Shenderov
(74) *Attorney, Agent, or Firm* — Osha Liang LLP

(57) ABSTRACT

An ejection device includes a discharger that discharges a droplet on an object; a motor that moves the discharger; an imaging device that captures an image of the object; and a controller that: controls the discharger and the motor; and receives the captured image from the imaging device. The discharger outputs a position adjusting mark on the object before discharging the droplet on the object. The controller adjusts a discharge position of the droplet based on the captured image of the object with the position adjusting mark.

18 Claims, 14 Drawing Sheets

Displacement Amount = |dy2 – dy1|

EJECTION DEVICE

TECHNICAL FIELD

The present invention relates generally to an ejection device.

BACKGROUND ART

Nail printers print on a fingernail a color or a pattern selected by a user to perform a nail design on a fingernail. For example, patent document 1 discloses a configuration of the nail printer that can perform a test painting using test paint paper.

DOCUMENTS OF THE PRIOR ART

Patent Documents

[Patent Document 1] Japanese Unexamined Patent Application Publication No. 2012-232039

SUMMARY OF THE INVENTION

In patent document 1, the test painting is performed to improve the quality of nail design. However, this configuration requires a test painting area in the nail printer, which makes it difficult to decrease the size of the printer. The test painting also increases running costs because it requires paper. Furthermore, because the test print area and an actual print area on the nail may differ, it is difficult to adjust the print position with high accuracy.

Meanwhile, there is demand for accurately ejecting a droplet on a portion of skin other than a nail, or a three dimensional object not on the human body (for example, an object created by a 3D printer, or a stereoscopic structure such as a cup, figure, seat, or the like) without the test paint.

One or more embodiments of the invention provide an ejection device that can eject a droplet such as ink with high accuracy without needing a test paint area or a test paint paper.

According to one or more embodiments of the invention, an ejection device comprises: a discharger that discharges a droplet on an object; a motor that moves the discharger; an imaging device that captures an image of the object; and a controller that: controls the discharger and the motor; and receives the captured image from the imaging device, wherein the discharger outputs a position adjusting mark on the object before discharging the droplet on the object, and the controller adjusts a discharge position of the droplet based on the captured image of the object with the position adjusting mark.

According to one or more embodiments of the invention, an ejection device can eject a droplet such as ink with high accuracy, without needing a test paint area or a test paint paper.

DETAILED DESCRIPTION OF THE INVENTION

Below, embodiments of the present invention will be described in detail with reference to the drawings.

First Example

Figure 1:
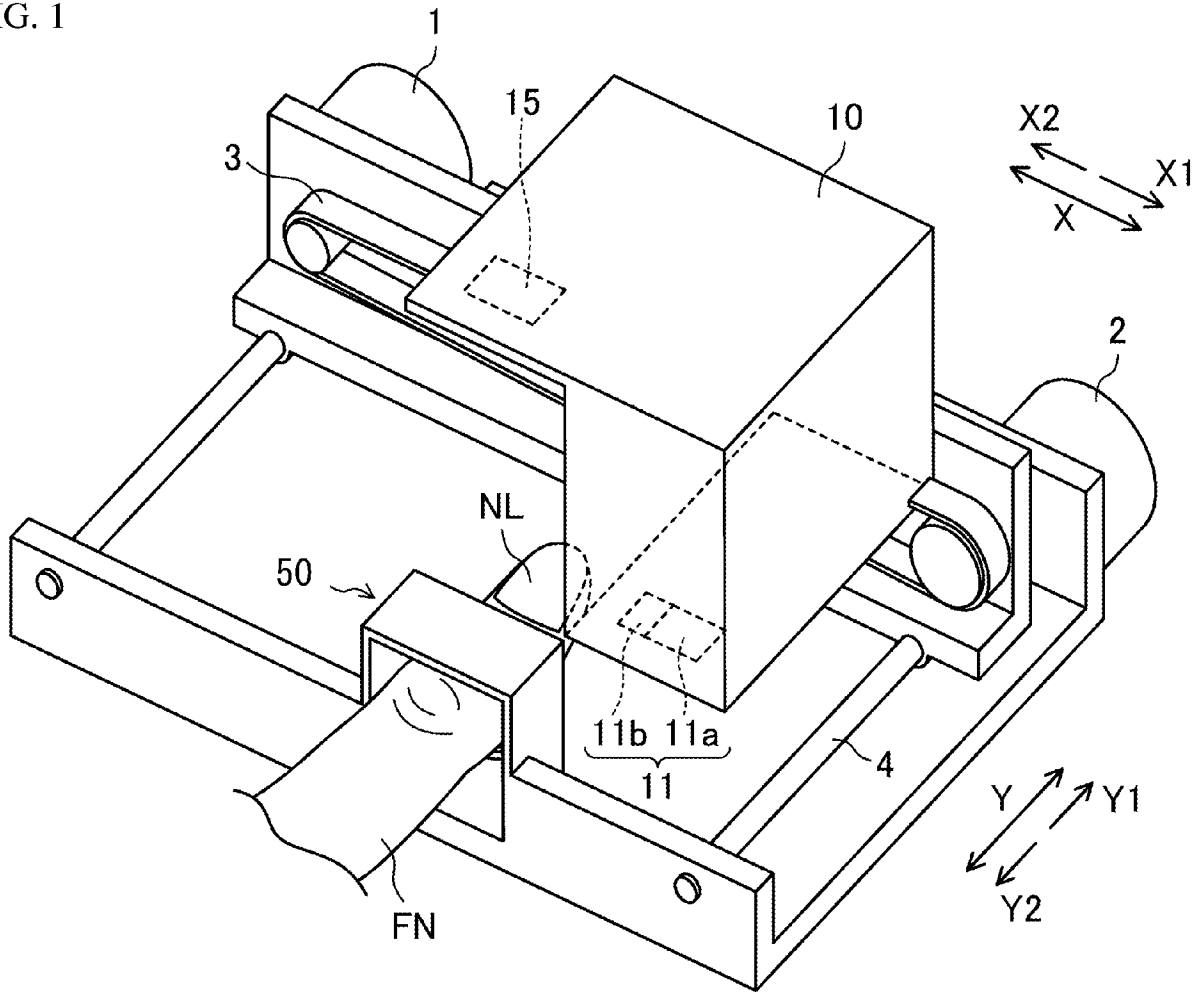
FIG. 1 shows a diagram illustrating a schematic configuration of components of a printer according to one or more embodiments of the invention.

First, an example will be described where the ejection device in accordance with one or more embodiments of the present invention is a nail printer that can print any color or pattern on a fingernail. FIG. 1 is a diagram illustrating the schematic configuration of components of a printer according to one or more embodiments of the invention. FIG. 1 shows a finger fixing mechanism 50 for fixing a finger FN to a prescribed position, and an ink mechanism 10 that performs printing on a nail NL of the finger FN placed in the prescribed position. FIG. 1 also shows an X-axis motor 1 that moves the ink mechanism 10 in the X direction, or in other words, in a direction that is orthogonal to a direction in which the finger FN extends in a planar view, by driving an X-axis motor belt 3 connected to the ink mechanism 10. Also shown is a Y-axis motor 2 that moves the ink mechanism 10 in a Y-direction, or in other words, the direction in which the finger FN extends, by rotating a Y-axis motor shaft 4 connected to the ink mechanism 10. A direction X1 and an opposite direction X2 are shown in the X direction, and a direction Y1 and an opposite direction Y2 are shown in the Y direction.

The ink mechanism 10 may have a print head 11 (example of discharge portion or discharger) for discharging ink (droplet) on the nail NL. The print head 11 includes a first print head 11*a* for colored ink, and a second print head 11*b* for primer ink. The first print head 11*a* for colored ink performs printing for carrying out a color design on the nail NL. The second print head 11*b* for primer ink performs printing for improving, for example, coloring of colored ink and the like. In the present example, the printing of a nail design is performed by the first print head 11*a*, and the application of a base coat and a top coat is performed by the second print head 11*b*. The number and type of print heads are not limited to that described here. Furthermore, here, the print head 11 is an ink jet type print head that performs printing by making ink into fine droplets and spraying directly on a nail. However, the printing type of the print head is not limited to an ink jet type.

Moreover, the ink mechanism 10 may have a camera 15 as an imaging portion (imaging device). The camera 15 images the nail NL of the finger FN placed on the prescribed position. The captured image is used to define the range of the nail NL, or in other words, the range wherein printing is performed.

Figure 2:
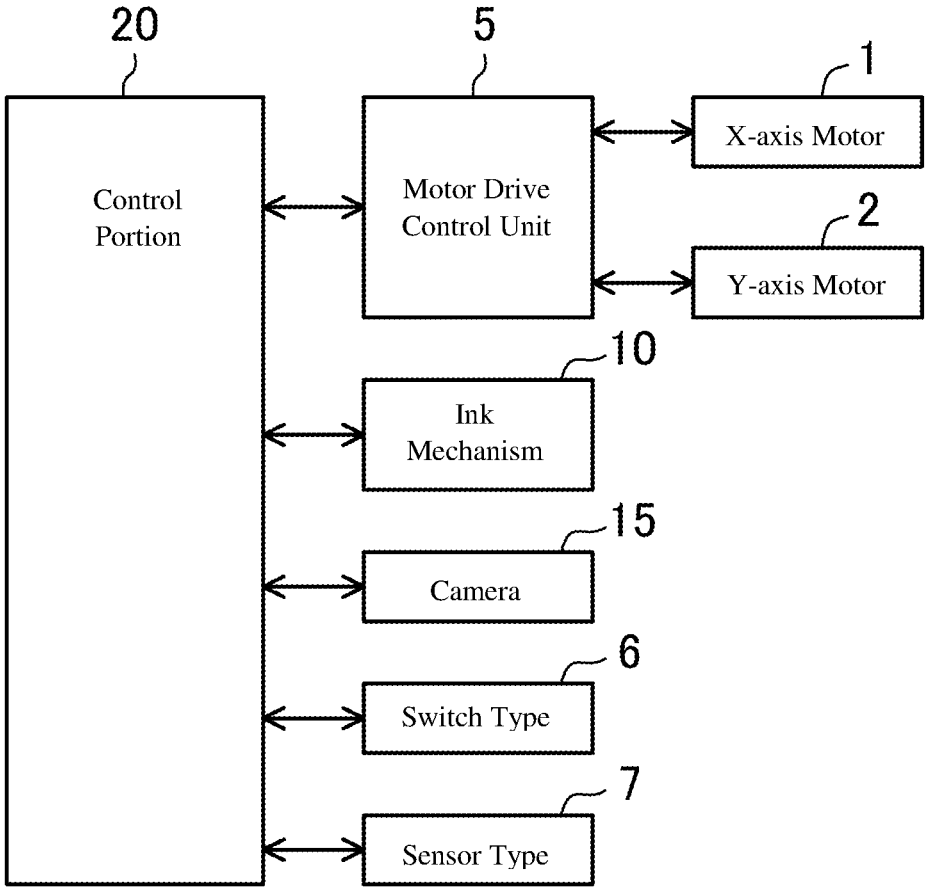
FIG. 2 shows a block diagram illustrating a functional configuration of a printer according to one or more embodiments of the invention.

FIG. 2 is a block diagram illustrating the functional configuration of a printer according to one or more embodiments of the invention. A control unit 20 (controller) controls a printing operation of a printer. For example, the control unit 20 performs input/output of a signal between a motor drive control unit 5, and controls the operation of the X-axis motor 1 and the Y-axis motor 2. A motor portion that moves the ink mechanism 10 by driving a motor is configured by the X-axis motor 1, Y-axis motor 2, X-axis motor belt 3, Y-axis motor shaft 4, and motor drive control unit 5. In other words, the control unit 20 controls the moving operation of the ink mechanism 10 by the motor portion.

Furthermore, the control unit 20 controls operation of the ink mechanism 10, for example, an operation for discharging ink from the print head 11. Furthermore, the captured image from the camera 15 is made to be input, and setting of, for example, the range of the nail NL, namely, the printing range is performed from this captured image. In addition to this, signal input/output between a switch type 6 and a sensor type 7 provided on the printer is also performed, although a detailed description is omitted.

In the present example, the ink mechanism 10 performs the operation for discharging ink while moving in an X direction (corresponding to a first direction) by the control of the control unit 20 when performing printing. The operation for discharging ink while moving in the X direction is performed repeatedly while moving in a Y direction (corresponding to a second direction perpendicular to the first direction). In other words, the operation is performed repeatedly until the ink mechanism 10 reaches an end of lines in the Y direction.

In the present example, the control unit 20 performs the print position (discharge position) adjusting operation before performing printing on the nail NL. With this print position adjusting operation, a position adjusting mark is printed (output) on the nail NL. Here, this is made for adjusting the print position in the X direction.

Figure 3:
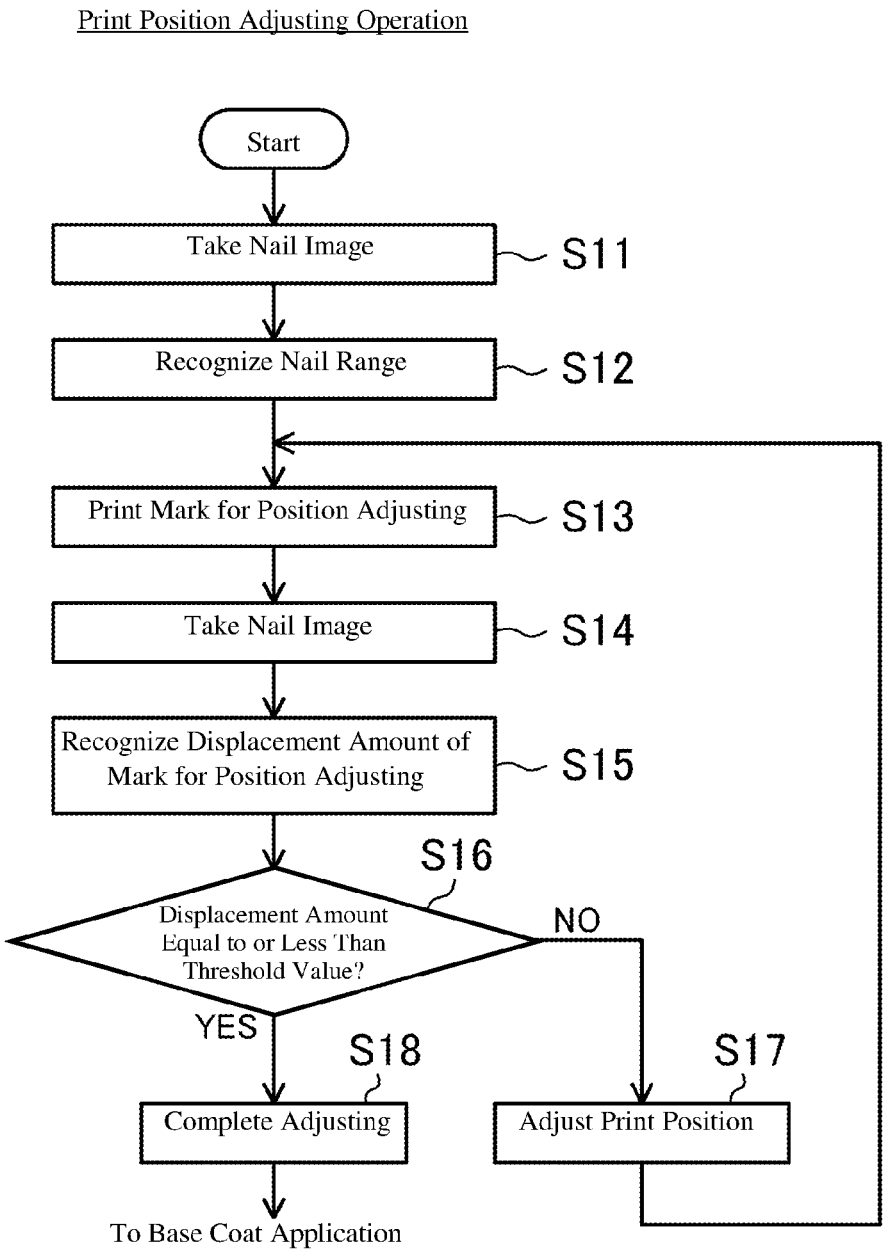
FIG. 3 shows a flow chart illustrating a flow of a print position adjusting operation according to one or more embodiments of the invention.
Figure 4A:
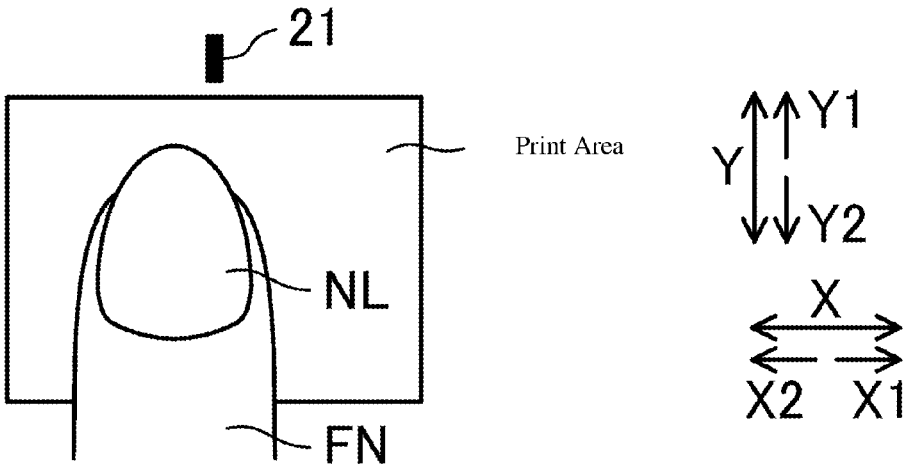
FIGS. 4A-4D each show a diagram illustrating a print position adjusting operation according to one or more embodiments of the invention.

FIG. 3 is a flow chart illustrating the flow of a print position adjusting operation according to one or more embodiments of the present invention. Following the flow of FIG. 3, the print position adjusting operation according to one or more embodiments of the present invention will be described with reference to FIG. 4. With the printer according to the present example, a reference mark 21 showing a reference position is provided on a housing in the vicinity of the print area where the nail NL of the finger FN is placed, as illustrated in FIG. 4A. The reference mark 21 may be, for example, a carved marking provided on the housing, or may be printed on the housing. The reference mark 21 is provided within an imaging range of the camera 15.

Figure 5A:
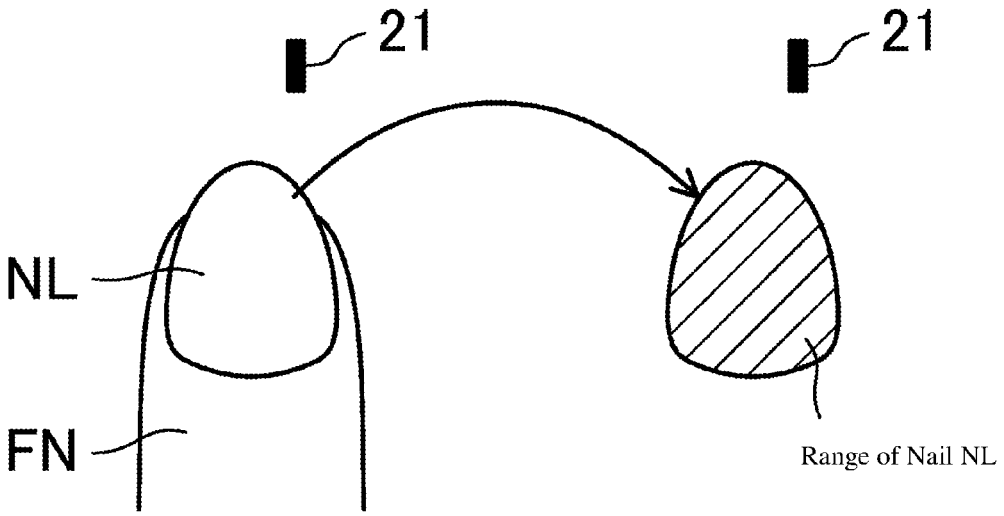
FIGS. 5A-5B each show a diagram illustrating an example of an image according to one or more embodiments of the invention.

The control unit 20 first acquires an image of the nail NL by capturing it with the camera 15 (S11). Then, as illustrated in FIG. 5A, the range of the nail NL is recognized from the acquired nail image by image recognition (S12). In FIG. 5A, the hatched range of the nail NL becomes the printing range. The control unit 20 may adjust an exposure or the like, and acquire a plurality of images in order to accurately recognize the printing range.

Figure 4B:
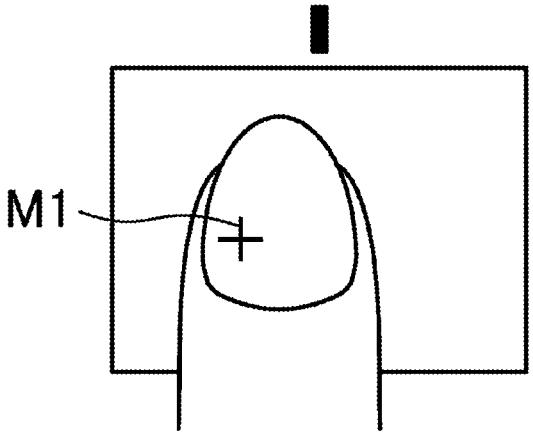

As illustrated in FIG. 4B, the control unit 20 prints a position adjusting mark M1 on the nail NL by the ink mechanism 10 (S13). The position adjusting mark M1 may, for example, be printed by the primer print head 11*b*. Furthermore, the position adjusting mark M1 may, for example, be printed in a color tone lower than the color tone of the ink used for printing the nail design. At this time, the control unit 20 prints the position adjusting mark M1 on, for example, a center portion of the prescribed position in the range of the nail NL recognized in the nail image. The control unit 20 can, for example, print the position adjusting mark M1 with a width (in the X-axis direction) of approximately 20% of the range of the nail NL, as illustrated in FIG. 4B. The control unit 20 can print the position adjusting mark M1 of any size. However, in reality, the position adjusting mark M1 is not limited to always being printed to the prescribed position in the nail range due to backlash and the like of the motor. In other words, there is a possibility of displacement occurring between the prescribed position where the control unit 20 intends to print, and the position where the printing actually takes place. Because of this, adjusting the print position is necessary.

Figure 5B:
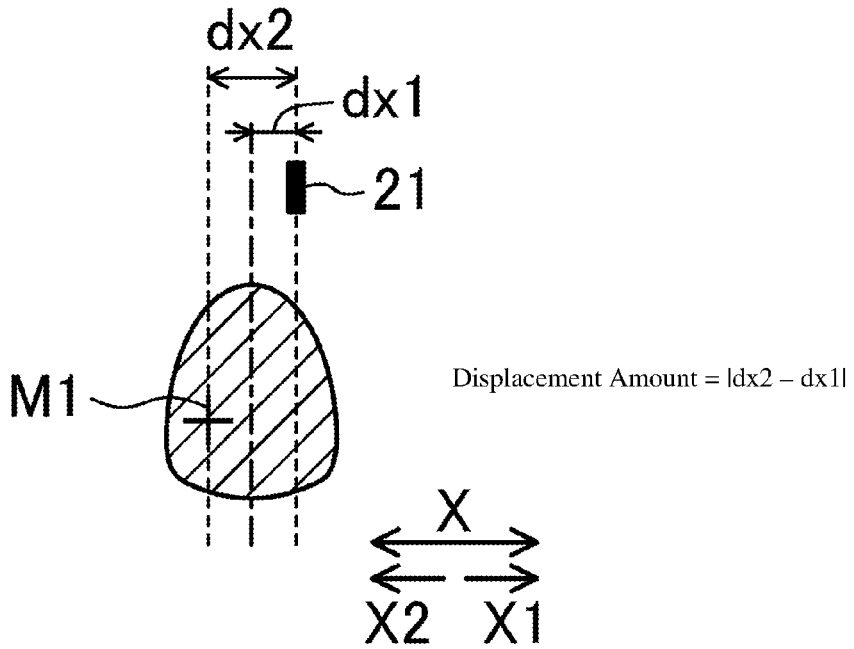

The control unit 20 acquires an image of the nail NL with the position adjusting mark M1 printed thereon by capturing it with the camera 15 (S14). Then, a displacement amount of the position adjusting mark M1 is recognized from the acquired nail image (S15). At this time, the displacement amount is recognized with the reference mark 21 as a reference. In other words, as illustrated in FIG. 5B, in the X direction, a displacement amount dx1 of the position of the reference mark 21 and a prescribed position in the nail range, for example, the center portion position shown with a dash-dot line in FIG. 5B) is requested, and a displacement amount dx2 of the position of the reference mark 21 and the print position of the position adjusting mark M1 is requested. Then, the displacement amount of the position adjusting mark M1 is requested by comparing these two displacement amounts dx1 and dx2. The displacement amount at this time is given a positive or negative value based on the direction of the displacement with the position of the reference mark 21 as zero. For example, the direction X1 side may be positive, and the direction X2 side may be negative. Furthermore, the control unit 20 may adjust an exposure or the like, and acquire a plurality of images to accurately recognize the displacement amount of the position adjusting mark M1.

Figure 4C:
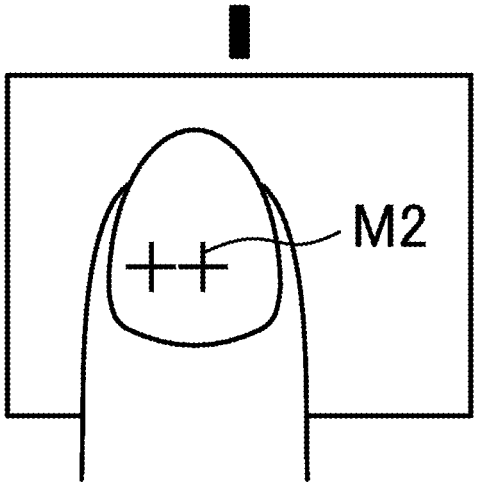

The control unit 20 determines whether the displacement amount of the position adjusting mark M1 ($|dx2-dx1|$) is equal to or less than an upper limit value (S16). The upper limit value here may, for example, be a value where it does not give an odd feeling when viewing the nail design printed on the nail NL. This can be, for example, 0.5 mm. Then, when the displacement amount of the position adjusting mark M1 exceeds the upper limit value (NO in S16), the print position by the ink mechanism 10 is adjusted by the motor portion to make the displacement amount of the position adjusting mark smaller (S17). Then, the flow is returned to step S13, and a position adjusting mark M2 is printed one more time, as illustrated in FIG. 4C.

Figure 4D:
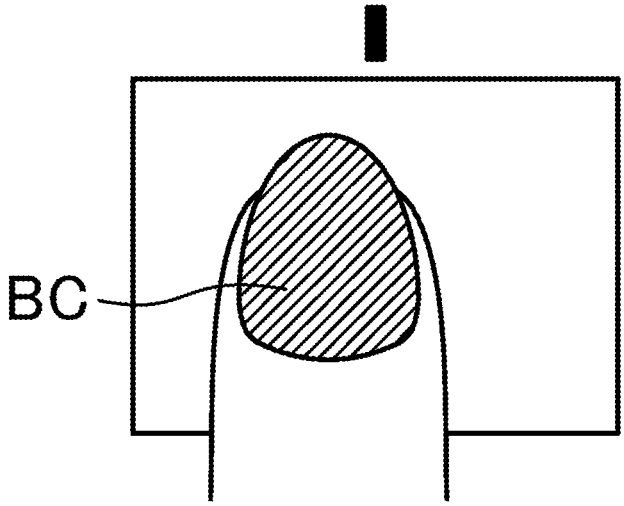

The control unit 20 finishes the adjusting (S18) when the displacement amount of the position adjusting mark M1 (or M2) is equal to or less than the upper limit value (YES in S16). Then, the flow moves to the printing operation for the nail design. Then, for example, as illustrated in FIG. 4D, the application of a base coat BC is performed. The position adjusting marks M1 and M2 are hidden by this base coat BC and disappear. After this, the printing of the nail design and the application of the top coat are performed.

In this manner, according to the present example, a print position adjusting operation is performed before performing printing on the nail NL. With this print position adjusting operation, the position adjusting mark M1 is printed on the nail NL, an image of the nail NL with the position adjusting mark M1 printed thereon is captured by the camera 15, and the print position by the ink mechanism 10 is adjusted based on the achieved nail image. As a result, because the accuracy of print position adjusting is higher due to the print position adjusting being performed on the location of the nail NL where the printing is actually performed, a complete, clean nail design can be realized. Furthermore, because it is not necessary to provide an additional test paint area for position adjusting, it is possible to make the printer smaller. Moreover, because a test print paper for position adjusting is unnecessary, cost of use to the user is reduced. Furthermore, because a print operation is performed to a nail following a print position adjusting operation, the operation by the user is simple, and can be completed without causing stress to the user.

Furthermore, the position adjusting mark printed in the print position operation is hidden by the base coat applied afterwards. Instead of this, for example, a separate mechanism may be provided that erases the printed position adjusting mark from the nail.

Second Example

The configuration and operation of the printer in the second example is substantially the same as the first example. In the present example, print position is adjusted in both the X direction and Y direction in the print position adjusting operation.

Figure 6A:
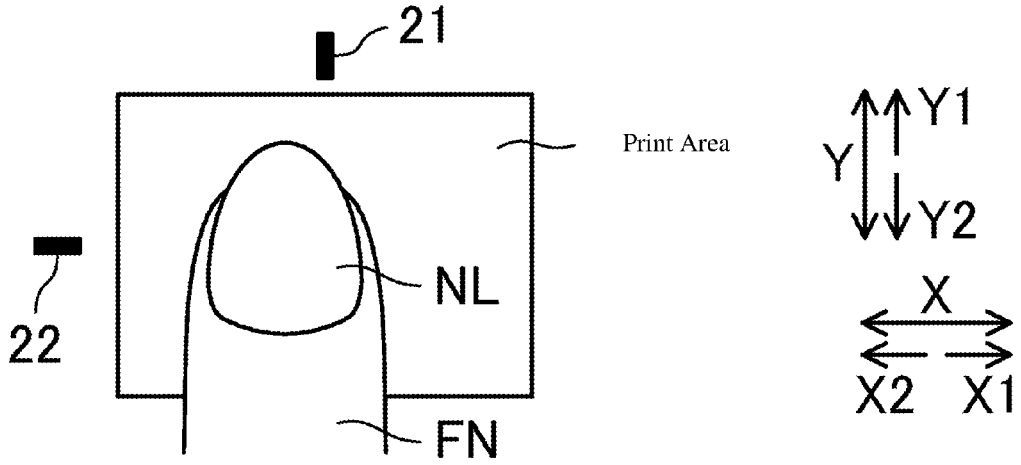
FIGS. 6A-6D each show a diagram illustrating a print position adjusting operation according to one or more embodiments of the invention.

Following the flow of FIG. 3, the print position adjusting operation according to one or more embodiments of the present invention will be described with reference to FIG. 6. With the printer according to the present example, reference marks 21 and 22 showing a reference position are provided on a housing in the vicinity of the print area where the nail NL of the finger FN is placed, as illustrated in FIG. 6A. The reference mark 21 is used for position adjusting in the X direction, and the reference mark 22 is used for position adjusting in the Y direction. The reference marks 21 and 22 may be, for example, carved markings provided on the housing, or may be printed on the housing. The reference marks 21 and 22 are provided within an imaging range of the camera 15.

The control unit 20 first acquires an image of the nail NL by capturing it with the camera 15 (S11). Then, the range of the nail NL is recognized from the acquired nail image by image recognition (S12). The recognized range of the nail NL becomes the printing range.

Figure 6B:
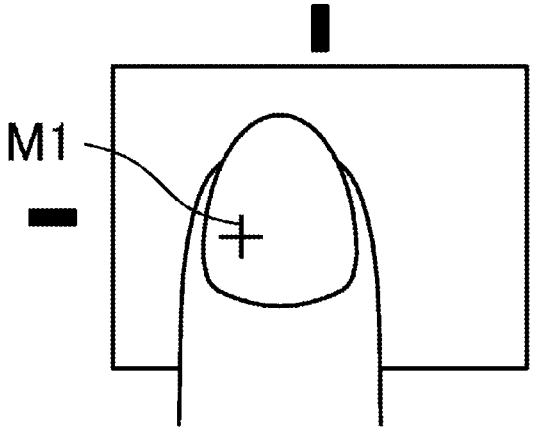

Then, as illustrated in FIG. 6B, the control unit 20 prints a position adjusting mark M1 on the nail NL by the ink mechanism 10 (S13). The position adjusting mark M1 may, for example, be printed by the primer print head 11*b*. At this time, the control unit 20 prints the position adjusting mark M1 in, for example, a prescribed position in the rage of the nail NL recognized in the nail image, for example, in the center portion. However, in reality, the position adjusting mark M1 is not necessarily limited to always being printed to the prescribed position in the nail range due to backlash and the like of the motor. In other words, there is a possibility of displacement occurring between the prescribed position where the control unit 20 intends to print, and the position where the printing actually takes place. Because of this, adjusting the print position is necessary.

Figure 7:
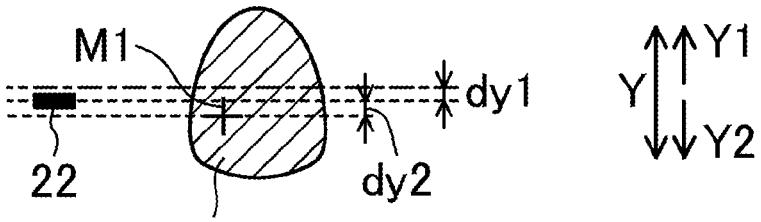
FIG. 7 shows a diagram for describing displacement amount recognition of a position adjusting mark according to one or more embodiments of the invention.

The control unit 20 acquires an image of the nail NL with the position adjusting mark M1 printed thereon by capturing it using the camera 15 (S14). Then, a displacement amount of the position adjusting mark M1 is recognized from the acquired nail image (S15). At this time, the displacement amount in the X direction is recognized with the reference mark 21 as a reference, and the displacement amount in the Y direction is recognized with the reference mark 22 as a reference. The recognition of the displacement amount in the X direction may be performed in the same manner as that described in the first example. Furthermore, the recognition of the displacement amount in the Y direction may also be performed in the same manner. In other words, as illustrated in FIG. 7, in the Y direction, a displacement amount dy1 of the position of the reference mark 22 and, for example, a center portion of the prescribed position in the nail range (position shown with a dash-dot line in FIG. 7) is requested, and a displacement amount dy2 of the position of the reference mark 22 and the print position of the position adjusting mark M1 is requested. Then, the displacement amount of the position adjusting mark M1 is requested by comparing these two displacement amounts dy1 and dy2. The displacement amount at this time is given a positive or negative value based on the direction of the displacement with the position of the reference mark 22 as zero. For example, the direction Y1 side may be positive, and the direction Y2 side may be negative.

Figure 6C:
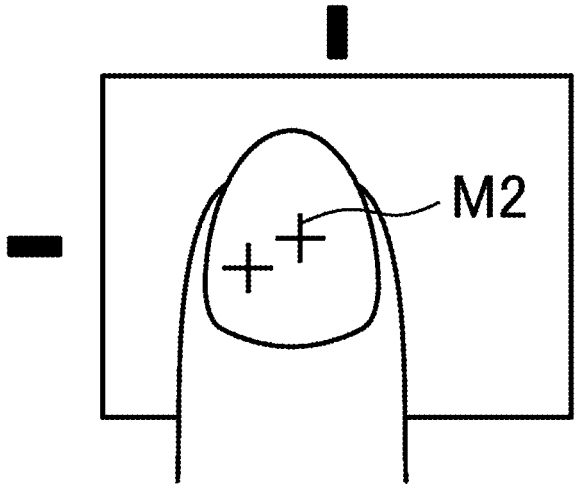

In both the X direction and the Y direction, the control unit 20 determines whether the displacement amount of the position adjusting mark M1 ($|dx2-dx1|$, $|dy2-dy1|$) is equal to or less than the upper limit value (S16). The upper limit value here may, for example, be a value where it does not seem strange when viewing the nail design printed on the nail NL. This may be, for example, 0.5 mm. Then, in either the X direction or the Y direction, when the displacement amount of the position adjusting mark M1 exceeds the upper limit value (NO in S16), the print position by the ink mechanism 10 is adjusted to make the displacement amount of the position adjusting mark smaller (S17). Then, the flow is returned to step S13, and a position adjusting mark M2 is printed one more time, as illustrated in FIG. 6C.

Figure 6D:
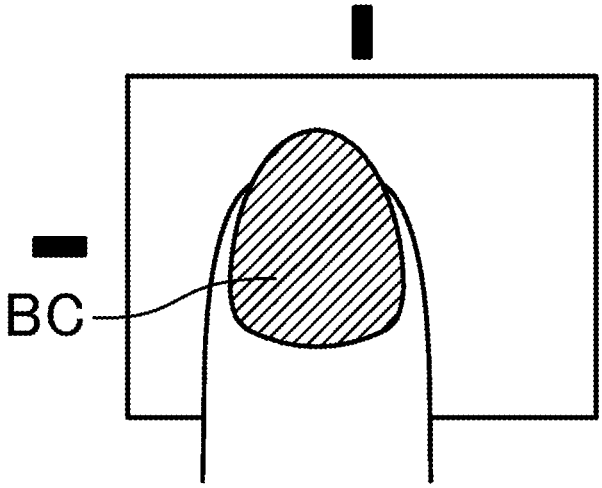

The control unit 20 finishes the adjusting (S18) when the displacement amount of the position adjusting mark M1 (or M2) is equal to or less than the upper limit value (YES in S16) in either of the X direction or the Y direction. Then, the flow moves to the printing operation for the nail design. Then, for example, as illustrated in FIG. 6D, the application of a base coat BC is performed. The position adjusting marks M1 and M2 are erased by this base coat BC. After this, the printing of the nail design and the application of the top coat are performed.

In this manner, according to the present example, a print position adjusting operation is performed before performing printing on the nail NL. With this print position adjusting operation, the position adjusting mark M1 is printed on the nail NL, an image of the nail NL with the position adjusting mark M1 printed thereon is captured by the camera 15, and the print position by the ink mechanism 10 is adjusted in both the X direction or Y direction based on the achieved nail image. As a result, the same effects as the first example can be achieved. In addition, because the print position adjusting is performed in the X direction and Y direction, the completed nail design is improved.

The upper limit value of the displacement amount of the position adjusting mark may be set to different value in the X direction and Y direction. For example, because print position in the Y direction may have a slightly lower accuracy compared to the X direction when performing interleave printing, the upper limit value of the displacement amount of the position adjusting mark in the Y direction may be set larger than that of the X direction. Furthermore, while in the first example print position was adjusted in the X direction, and in the second example print position was adjusted in both the X direction and Y direction, in addition to this, print position may be adjusted in only the Y direction. In this case, the reference mark 21 becomes unnecessary.

Third Example

The configuration and operation of the printer in the third example is substantially the same as the first example. In the present example, the printer performs printing back and forth in the X direction. In other words, the ink mechanism 10 performs an operation for discharging ink while moving in the X direction both when moving in the direction X1 (corresponding to the first direction), and when moving in the opposite direction X2 (second direction that faces away from the first). Then the control unit 20 adjusts print position individually for both the direction X1 and the direction X2 in the print position adjusting operation.

Figure 8:
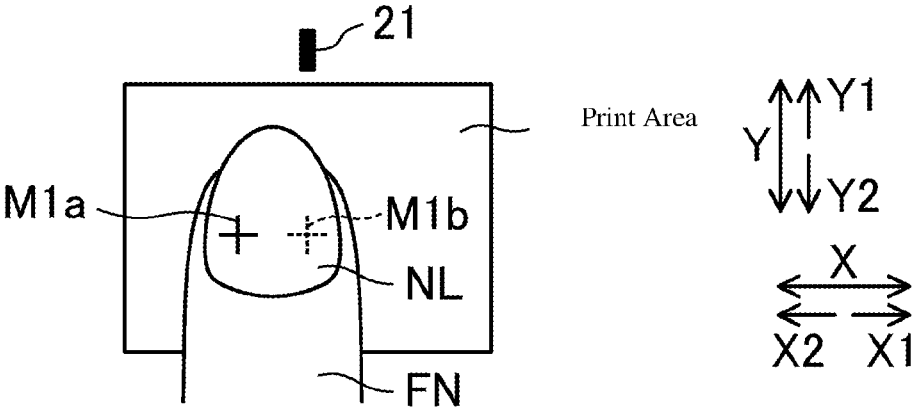
FIG. 8 shows a diagram illustrating a print position adjusting operation according to one or more embodiments of the invention.

In the present example, in step S13 in the flow of FIG. 3, a position adjusting mark M1*a* is printed when the ink mechanism 10 moves in the direction X1, and a position adjusting mark M1*b* is printed when the ink mechanism 10 moves in the direction X2, as illustrated in FIG. 8. Then, print position is adjusted in the direction X1 following the displacement amount of the position adjusting mark M1*a*, and print position is adjusted in the direction X2 following the displacement amount of the position adjusting mark M1*b*.

Because backlash components have directivity in the motor portion that moves the ink mechanism 10, it is advantageous to adjust print positions in both directions, particularly when performing printing in two directions. In the present example, because each position adjusting mark M1*a* and M1*b* is printed for both directions, and the print position is adjusted individually, position displacement of printing disappears with the back and forth motions of the ink mechanism 10, and a clean nail design can be printed.

In the second example, print position may be adjusted individually for both directions of the back and forth motion in both the X direction and the Y direction, or in only one of either direction, in a same manner as the present example.

According to one or more embodiments of the present invention, a nail printer that performs printing on a nail of a finger may comprise an ink mechanism, a motor portion for moving the ink mechanism, an imaging portion that images the nail, and a control unit that controls operation of the ink mechanism and a movement operation of the ink mechanism by the motor portion, and has a captured image from the imaging portion as input, wherein the control unit prints a position adjusting mark on the nail by the ink mechanism before performing printing on the nail, and adjusts the print position by the ink mechanism based on the image of the nail where the position adjusting mark is printed.

According to one or more embodiments, a position adjusting mark is printed before performing printing on a nail, and a print position by the ink mechanism can be adjusted based on an image of the nail where the position adjusting mark is printed. As a result, because the accuracy of print position adjusting is higher due to the print position adjusting being performed on the location of the nail where the printing is actually performed, a complete, clean nail design can be realized. Furthermore, because it is not necessary to provide an additional test paint area for position adjusting, it is possible to make the printer smaller. Moreover, because a test print paper for position adjusting is unnecessary, cost of use to the user is reduced. Furthermore, because a print operation is performed to a nail following a print position adjusting operation, the operation by the user is simple, and can be completed without causing stress to the user.

According to one or more embodiments of the invention, the control unit may perform an application of a base coat on the nail by the ink mechanism after the print position is adjusted.

According to this configuration, a position adjusting mark printed when adjusting the print position is hidden by the base coat applied afterward.

Furthermore, according to one or more embodiments of the invention, a reference mark showing a reference position is provided in an imaging range of the nail image in a housing, and when adjusting the print position, the control unit may recognize a displacement amount of the position of the position adjusting mark to the reference mark shown in the nail image, and adjust the print position based on this displacement amount.

According to one or more embodiments of the invention, a print position can be accurately adjusted in a nail image because print position is adjusted based on a displacement amount of the position of a position adjusting mark to a reference mark provided in a housing.

Furthermore, according to one or more embodiments of the invention, the control unit may acquire the nail image before the position adjusting mark is printed, and print the position adjusting mark on a prescribed position in the range of the nail recognized from the nail image.

According to one or more embodiments of the invention, the position adjusting mark is surely printed on the nail because the position adjusting mark is printed on a prescribed position in the range of the nail recognized from the nail image.

Furthermore, according to one or more embodiments of the invention, the ink mechanism repeats an operation for discharging ink while moving in a first direction while also moving in a second direction perpendicular to the first direction when carrying out printing, and the control unit performs adjusting of the print position in at least one of the first and second directions.

According to one or more embodiments of the invention, adjusting of the print position is performed in at least one of a first and second direction in which the ink mechanism moves when printing is performed.

Furthermore, according to one or more embodiments of the invention, the ink mechanism repeats an operation for discharging ink while moving in a first direction while also moving in a second direction perpendicular to the first direction when printing, and performs an operation for discharging ink in the first direction both when moving in a first direction and when moving in a second direction opposite the first direction in the first direction, and the control unit prints a position adjusting mark both when the ink mechanism moves in the first direction and when it moves in the second direction, and performs adjusting of the print position individually for the first and second directions.

According to one or more embodiments of the invention, a print position is adjusted individually for each direction when printing is performed in both directions in a printing direction.

According to one or more embodiments of the invention, a nail print method for performing printing on a nail of a finger using a nail printer is provided, wherein the nail printer may comprise an ink mechanism, a motor portion for moving the ink mechanism by driving a motor, and an imaging portion for imaging the nail, wherein the nail printer prints a position adjusting mark on the nail by the ink mechanism before performing printing on the nail, and adjusts a print position by the ink mechanism based on an image of the nail where the position adjusting mark is printed.

According to one or more embodiments of the invention, a position adjusting mark is printed on a nail before performing printing on the nail, and a print position by the ink mechanism is adjusted based on an image of the nail where the position adjusting mark is printed. As a result, because the accuracy of print position adjusting is higher due to the print position adjusting being performed on the location of the nail where the printing is actually performed, a complete, clean nail design can be realized. Furthermore, because it is not necessary to provide an additional test paint area for position adjusting, it is possible to make the printer smaller. Moreover, because a test print paper for position adjusting is unnecessary, cost of use to the user is reduced. Furthermore, because a print operation is performed to a nail following a print position adjusting operation, the operation by the user is simple, and can be completed without causing stress to the user.

According to one or more embodiments of the present invention, a nail printer that performs printing on a nail of a finger may comprise an ink mechanism, a motor portion that moves the ink mechanism, and an imaging portion that images the nail, and print a position adjusting mark on the nail by the ink mechanism before performing printing on the nail, and afterwards perform an application of a base coat on the nail by the ink mechanism.

According to one or more embodiments of the invention, a position adjusting mark is printed on a nail before performing printing on the nail, and afterwards an application of a base coat is performed on the nail. As a result, because the accuracy of print position adjusting is higher because the print position adjusting by a position adjusting mark can be performed on a location of the nail where the printing is actually performed, a complete, clean nail design can be realized. Furthermore, the position adjusting mark printed in the print position operation is hidden by the base coat applied afterwards.

Figure 9:
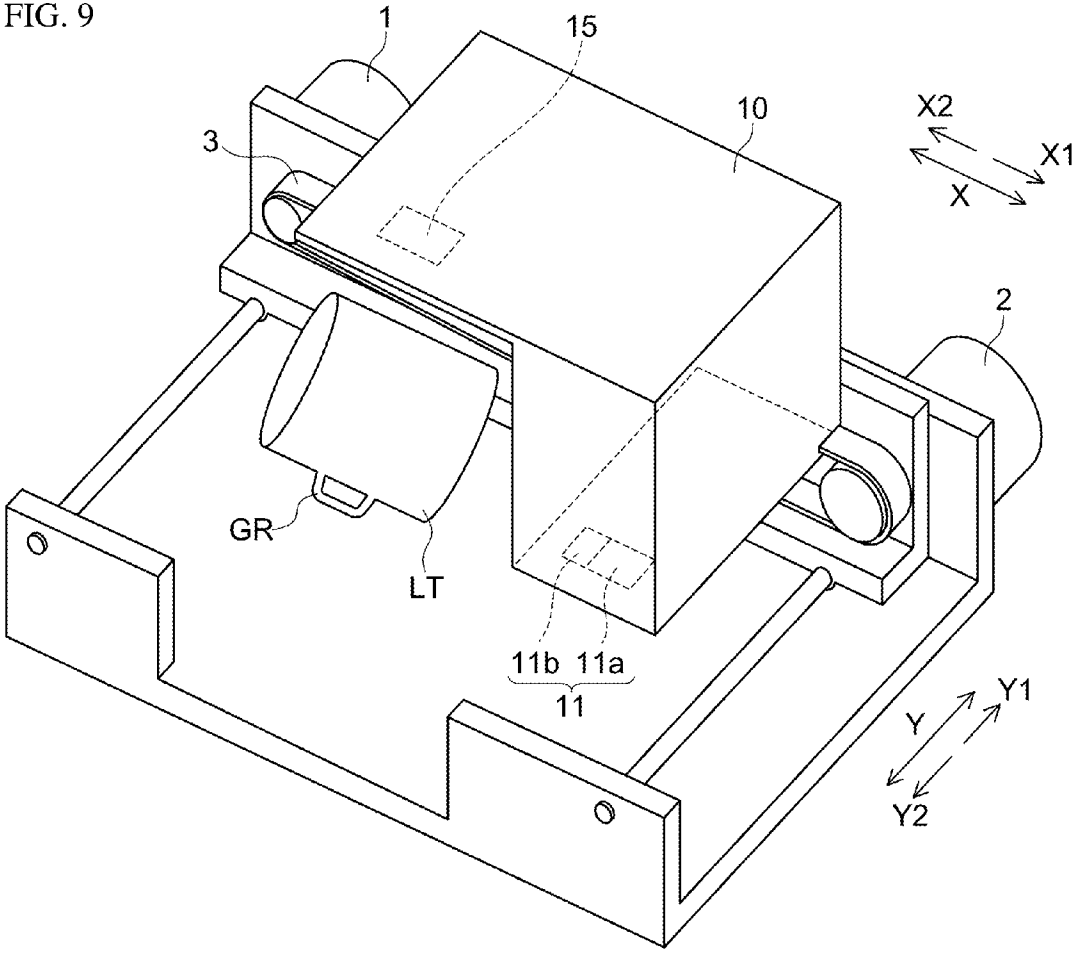
FIG. 9 shows a diagram illustrating the schematic configuration of components of a printer according to one or more embodiments of the invention.

Next, an example will be described where a printer according to one or more embodiments of the present invention is a printer that performs printing on, for example, an object created by a 3D printer, or a stereoscopic structure having a three dimensional shape such as a cup, a figure, or a seat. FIG. 9 is a diagram illustrating the schematic configuration of components of a printer according to one or more embodiments of the present invention.

The printer illustrated in FIG. 9 is substantially the same as the nail printer described using FIG. 1 in terms of basic structure, but can print any color, illustration, pattern or the like on not only a nail of a finger but can print any color, graphic, pattern, and the like on a stereoscopic structure having a three dimensional shape (below, referred to as "object"). The printer illustrated in FIG. 9 is different from the nail printer of FIG. 1 in that it does not have the finger fixing mechanism 50. The user inserts the object into a print region of the ink mechanism 10 from a Y2 direction and waits for the printing process to complete while holding the object the way it is, or holding the object by a holding mechanism not shown in the drawings (for example, an arm, clamp, pedestal or the like). In FIG. 9, a printer is disclosed that has a size that can hold a cup in the print region, but the present invention is not limited to this example. For example, when a figure about the size of a human finger or a part of skin on the body other than a finger (cheek or the like) is the object, the printer can be made smaller.

Figure 10:
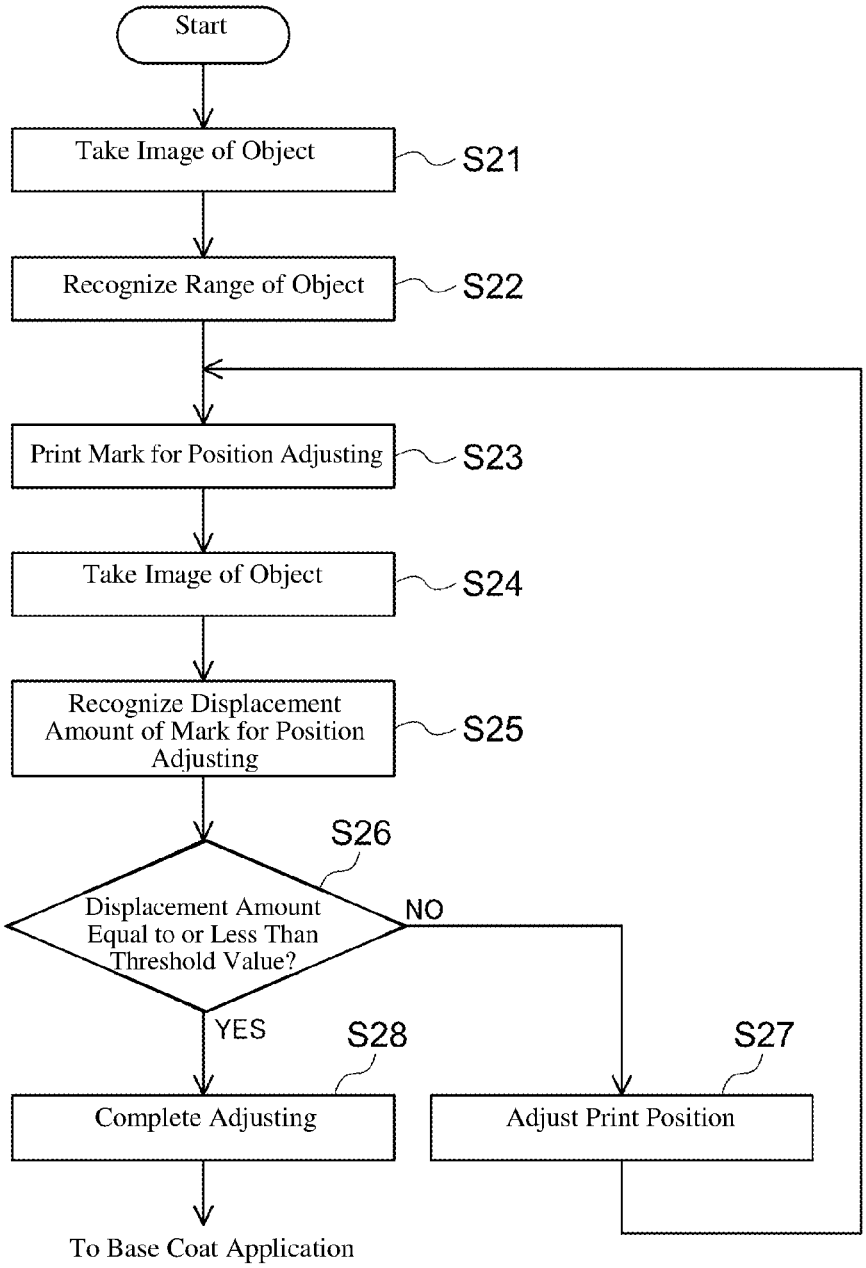
FIG. 10 shows a flow chart illustrating the flow of a print position adjusting operation according to one or more embodiments of the invention.

FIG. 10 is a flow chart illustrating the flow of a print position adjusting operation according to one or more embodiments of the present invention. The basic flow of operation is the same as the flow chart illustrated in FIG. 3. In the example of FIG. 3, the object to be printed on is a nail of a finger; an image of it is captured (S11) and, after recognizing the range of the nail (S12), a position adjusting mark is printed (S13), and a nail image is captured (S14). Meanwhile, the example of FIG. 10 is different in that the object to be printed on is an object having three dimensions. Here, a description will be given where the object is a cup illustrated in FIG. 9.

Figure 11A:
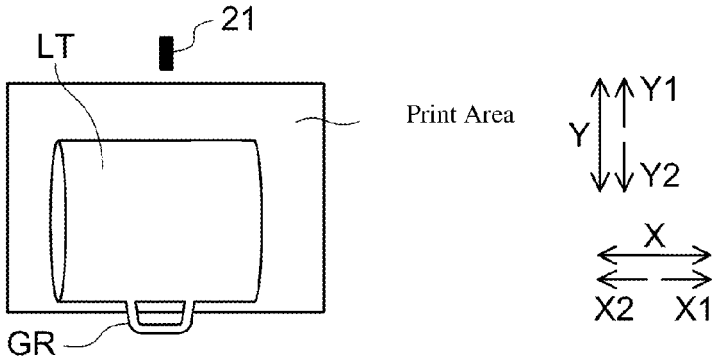
FIGS. 11A-11D each show a diagram illustrating a print position adjusting operation according to one or more embodiments of the invention.
Figure 12A:
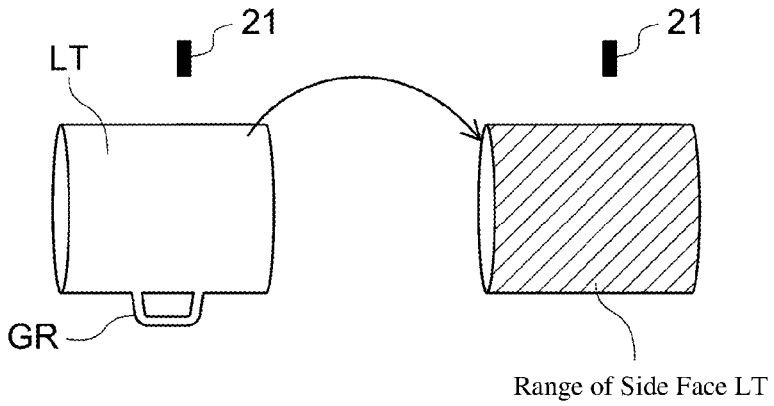
FIGS. 12A-12B each show a diagram illustrating an example of an image according to one or more embodiments of the invention.

The control unit 20 acquires an image of a side face LT of the cup that is the object to be printed on by capturing it with a camera 15 (S21). Then, as illustrated in FIG. 11A, the range of the side face LT is recognized from the acquired image of the object by image recognition (S22). The hatched range of the side face LT becomes the print range in FIG. 12A.

Figure 11B:
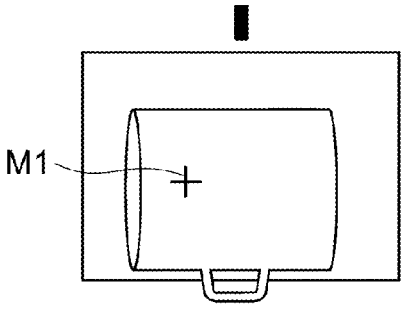
Figure 12B:
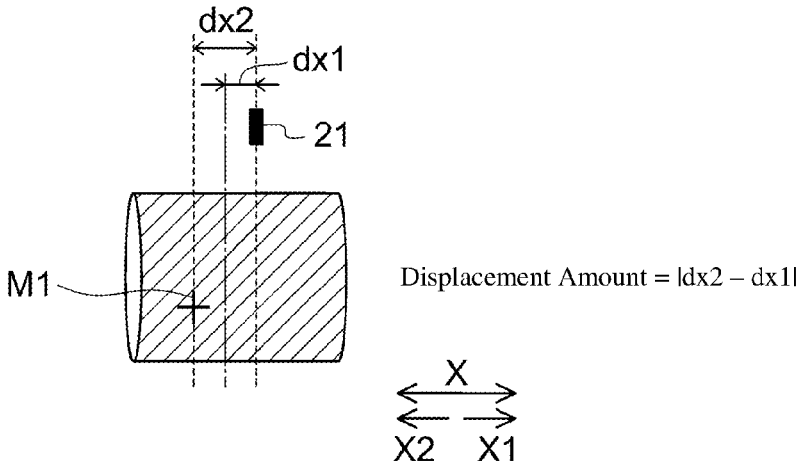

Next, the control unit 20 prints the position adjusting mark M1 on the side face LT by the ink mechanism 10 (S23), as illustrated in FIG. 11B. The printing method of the position adjusting mark M1 is as described above. As described above, the position adjusting mark M1 may be printed in a color tone lower than the color tone of the ink used when printing the design. The control unit 20 acquires an image of the side face LT with the position adjusting mark M1 printed thereon by capturing it with the camera 15 and acquires it (S24). Then, a displacement amount of the position adjusting mark M1 is recognized from the acquired image of the object (S25). The displacement amount is calculated based on the displacement of the position of the reference mark 21 and the print position of the position adjusting mark M1, as illustrated in FIG. 12B.

Figure 11C:
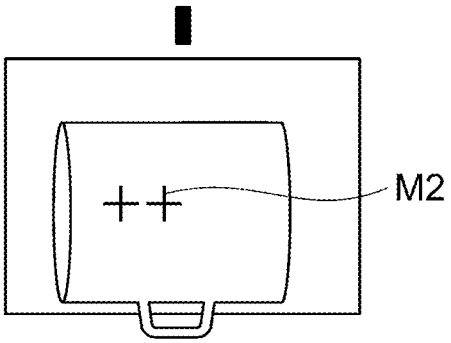
Figure 11D:
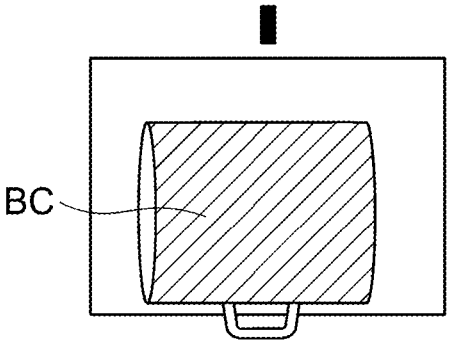

Afterwards, when the displacement amount exceeds the upper limit value (NO in S26), the control unit 20 adjusts the print position (S27), and afterwards prints again a position adjusting mark M2 as illustrated in FIG. 11C (S23). Meanwhile, when the displacement amount is equal to or less than the upper limit value (YES in S26), the control unit 20 completes adjusting (S28), and applies a base coat BC on the side face LT, as illustrated in FIG. 11D. After this, the printing of any design and the application of the top coat are performed.

In this manner, according to one or more embodiments of the present invention, a print position adjusting operation is performed before performing printing on the print face of the object. For example, when a side face LT of the cup illustrated in FIG. 9 is the print face, the position adjusting mark M1 is printed on the side face LT, an image of the side face LT with the position adjusting mark M1 printed thereon is captured by the camera 15, and the print position by the ink mechanism 10 is adjusted based on the achieved image. As a result, because the accuracy of print position adjusting is higher due to the print position adjusting being performed on the side face LT where the printing is actually performed, the design can be printed just as the user intends. Furthermore, because it is not necessary to provide an additional test paint area for position adjusting, it is possible to make the printer smaller. Moreover, because a test print paper for position adjusting is unnecessary, cost of use to the user is reduced.

The ejection device according to the present invention is not limited to a nail printer. For example, in accordance with one or more embodiments described above, the ejection device may be a printer that can print a design pattern on a cup, a figure, a bicycle seat, human bodies, etc. According to one or more embodiments of the present invention, the print head 11 included in the ink mechanism 10 of the printer may discharge a droplet such as a cosmetic or a fluid with a medicine acting on skin or the like mixed in a liquid, instead of ink. As a result, for example, a cosmetic or medicine can be applied to human skin with high accuracy.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

INDUSTRIAL APPLICABILITY

The present invention is useful for improvements in product quality, miniaturization, and reduction in the usage cost of a printer.

DESCRIPTION OF THE REFERENCE NUMERALS

1 X-axis motor
2 Y-axis motor
3 X-axis motor belt
4 Y-axis motor shaft
5 Motor drive control unit
10 Ink mechanism
15 Camera (imaging portion)
20 Control unit
21, 22 Reference mark
M1, M2, M1*a*, M1*b* Position adjusting mark
BC Base coat
FN Finger
NL Nail

What is claimed is:

1. An ejection device, comprising:
a discharger that discharges a droplet on an object;
a motor that moves the discharger;
an imaging device that captures an image of the object; and
a controller that:
controls the discharger and the motor; and
receives the captured image from the imaging device,
wherein the discharger outputs a position adjusting mark on the object before discharging the droplet on the object,
wherein the controller adjusts a discharge position of the droplet based on the captured image of the object with the position adjusting mark,
wherein a reference mark on a housing of the ejection device is provided in an imaging range for the captured image of the object and outside a print area of the discharger,
wherein the controller detects a displacement amount of distance between the position adjusting mark and the reference mark shown on the captured image of the object, and
wherein the controller adjusts the discharge position based on the displacement amount.

2. The ejection device according to claim 1, wherein the discharger applies a base coat on the object after the discharge position is adjusted.

3. The ejection device according to claim 1, wherein
the controller receives the captured image of the object before the position adjusting mark is output, and
the discharger outputs the position adjusting mark at a predetermined position in a range of the object recognized from the captured image.

4. The ejection device according to claim 3, wherein the predetermined position is a center of the range of the object.

5. The ejection device according to claim 1, wherein
the discharger discharges the droplet while moving in a first direction,
the discharger repeats the discharging of the droplet until the discharger reaches an end of lines in a second direction perpendicular to the first direction, and
the controller adjusts the discharge position in at least one of the first and the second direction.

6. The ejection device according to claim 1, wherein
the discharger discharges the droplet while moving in a first direction and an opposite direction against the first direction,
the discharger repeats the discharging of the droplet until the discharger reaches an end of lines in a second direction perpendicular to the first direction,
the discharger outputs the position adjusting mark when moving in the first direction and also when moving in the opposite direction, and
the controller adjusts the discharge position individually for the first and the opposite direction.

7. The ejection device according to claim 1, wherein when the displacement amount exceeds a threshold value, the controller adjusts the discharge position to decrease the amount of displacement, and the discharger further outputs the position adjusting mark.

8. The ejection device according to claim 1, wherein the position adjusting mark is output at a lower color tone than the droplet discharged on the object.

9. The ejection device according to claim 1, wherein the position adjusting mark is output at a width of approximately 20% of a range of the object recognized from the captured image.

10. The ejection device according to claim 1, wherein
the imaging device captures multiple images of the object before the position adjusting mark is output, and
the controller recognizes the range of the object based on the captured images of the object.

11. The ejection device according to claim 1, wherein
the imaging device captures multiple images of the object with the position adjusting mark after the position adjusting mark is output, and
the controller adjusts the discharge position based on the captured images of the object with the position adjusting mark.

12. The ejection device according to claim 1, wherein the reference mark is provided on each of two axes that go through a center of the imaging range and are perpendicular to each other, and the controller detects the displacement amount in each of the axes and adjusts the discharge position based on the detected displacement amount in each of the axes.

13. The ejection device according to claim 12, wherein the controller adjusts the discharge position to decrease the displacement amount when the displacement amount of one of the two axes exceeds a first threshold value or when the displacement amount of the other axis exceeds a second threshold value.

14. The ejection device according to claim 13, wherein the second threshold value is higher than the first threshold value.

15. The ejection device according to claim 14, wherein the second threshold value is set for the displacement amount in one of the two axes perpendicular to a direction in which the discharger moves while discharging the droplet.

16. The ejection device according to claim 1, wherein the droplet is a cosmetic.

17. The ejection device according to claim 1, wherein the droplet is a medicine.

18. The ejection device according to claim 1, further comprising a fixing mechanism that fixes the object.

* * * * *